US010281159B2

(12) United States Patent
Park et al.

(10) Patent No.: US 10,281,159 B2
(45) Date of Patent: May 7, 2019

(54) STEAM COOKING APPARATUS

(75) Inventors: Guen Yong Park, Hwaseong-si (KR); Jae Hyoun Kim, Hwaseong-si (KR); Cheol Jin Kim, Suwon-si (KR); Han Seong Kang, Hwasung-si (KR); Jin Hae Cho, Seoul (KR); Eun Oh Kim, Seoul (KR); Chan Park, Hwaseong-si (KR); Dong-Ho Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1136 days.

(21) Appl. No.: 13/456,897

(22) Filed: Apr. 26, 2012

(65) Prior Publication Data

US 2012/0273477 A1 Nov. 1, 2012

(30) Foreign Application Priority Data

Apr. 28, 2011 (KR) ..... 10-2011-0040147

(51) Int. Cl.
*A47J 27/21* (2006.01)
*F24C 15/32* (2006.01)

(52) U.S. Cl.
CPC ..... *F24C 15/327* (2013.01)

(58) Field of Classification Search
CPC ..... F24C 15/327; A21B 3/04; F16L 25/10; A23B 7/144; A21C 13/00; A47J 27/04; A23N 7/005
USPC ..... 99/467, 468, 473, 474, 418, 415; 126/21 A, 369; 219/682, 401, 400, 681; 392/452, 455, 501
See application file for complete search history.

(56) References Cited

U.S. PATENT DOCUMENTS 3,891,817 A 6/1975 Brown
5,387,256 A * 2/1995 Enomoto ..... 99/286
5,869,812 A 2/1999 Creamer et al.
(Continued)

FOREIGN PATENT DOCUMENTS

CA 2517613 A1 * 5/2006
CN 1969723 A 5/2007
(Continued)

OTHER PUBLICATIONS

Partial European Search Report dated Jun. 15, 2015 from European Patent Application No. 12165671.4, 7 pages.
(Continued)

*Primary Examiner* — Jimmy Chou
(74) *Attorney, Agent, or Firm* — Staas & Halsey LLP

(57) ABSTRACT

A steam cooking apparatus with improved water supply and drainage structures. The apparatus includes a body, a cooking compartment, a steam generator to supply steam into the cooking compartment, a water vessel to store water and supply the water into the steam generator, a water supply device including a holder and a slider slidably mounted in the holder so as to be withdrawn from the body, a first water supply tube connecting the slider and the water vessel, a second water supply tube connecting the water vessel and the steam generator, and a drain tube to drain water in the steam generator to the outside of the body. The drain tube includes an end fixed to the slider so that the end of the drain tube is withdrawn with the slider from the body when water in the steam generator is drained to the outside.

25 Claims, 10 Drawing Sheets

(56) References Cited

U.S. PATENT DOCUMENTS

| | | | | |
|---|---|---|---|---|
| 6,289,177 | B1 * | 9/2001 | Finger | F24H 1/102 392/447 |
| 7,537,004 | B2 * | 5/2009 | Reay | 126/369 |
| 8,283,610 | B2 * | 10/2012 | Hirano | 219/520 |
| 8,367,977 | B2 * | 2/2013 | Lehman et al. | 219/386 |
| 2004/0040954 | A1 * | 3/2004 | Kim | 219/681 |
| 2007/0006864 | A1 * | 1/2007 | Kobayashi | A21B 3/04 126/20 |
| 2007/0114222 | A1 * | 5/2007 | Shon | A21B 3/04 219/401 |
| 2008/0115381 | A1 * | 5/2008 | Bae et al. | 34/60 |
| 2009/0107477 | A1 * | 4/2009 | Frock et al. | 126/20.2 |

FOREIGN PATENT DOCUMENTS

| | | | |
|---|---|---|---|
| CN | 101153814 | A | 4/2008 |
| CN | 2 175 178 | | 4/2010 |
| CN | 101943394 | | 1/2011 |
| EP | 1 654 931 | A2 | 5/2006 |
| EP | 1 724 529 | | 11/2006 |
| FR | 2678359 | | 12/1992 |
| FR | 2958719 | | 10/2011 |
| JP | 2005-188800 | | 7/2005 |
| KR | 10-2006-0040343 | | 5/2006 |
| KR | 10-2006-0117571 | | 11/2006 |
| KR | 10-2008-0023362 | | 3/2008 |
| KR | 1020050039501 | * | 3/2008 |
| KR | 10-2008-0029006 | | 4/2008 |

OTHER PUBLICATIONS

Chinese Office Action dated Jan. 20, 2016 in corresponding Chinese Patent Application 201210128242.X.

Chinese Decision on Grant dated Jul. 21, 2016 in corresponding Chinese Patent Application No. 201210128242.X.

European Office Action dated Jun. 16, 2017 from European Patent Application No. 12165671.4, 4 pages.

Korean Office Action dated Apr. 17, 2017 from Korean Patent Application No. 10-2011-0040147, 26 pages.

Korean Notice of Allowance dated Nov. 9, 2017 in Korean Patent Application No. 10-2011-0040147.

European Communication under Rule 71(3) dated May 16, 2018 in European Patent Application No. 12165671.4.

* cited by examiner

STEAM COOKING APPARATUS

CROSS-REFERENCE TO RELATED APPLICATIONS

This application claims the priority to Korean Patent Application No. 10-2011-0040147, filed on Apr. 28, 2011 in the Korean Intellectual Property Office, the disclosure of which is incorporated herein by reference.

BACKGROUND

1. Field

Embodiments of the present invention relate to a steam cooking apparatus configured to cook food using steam.

2. Description of the Related Art

Cooking apparatuses used to cook food include a microwave oven using high frequency microwaves, and a gas oven and an electric oven designed to directly apply heat to food using a heater. Of the above-mentioned cooking apparatuses, the microwave oven has great limitation as to the kind of food which can be cooked thereby and suffers from deterioration in the taste of the cooked food because it causes excessive drying of the food. The gas oven and the electric oven have problems of excessively long cooking time and low cooking efficiency because they use air having a relatively low density as a heat transfer medium between the heater and food to be cooked.

Recently, as a solution to overcome the above-described problems of the cooking apparatuses, a novel cooking apparatus (hereinafter, referred to as "steam cooking apparatus") has been developed. The steam cooking apparatus is designed to heat food using steam. When cooking food using the steam cooking apparatus, it is possible to maintain an appropriate amount of moisture in food and consequently, maintain original taste of food. Also, steam filling a cooking compartment of the steam cooking apparatus acts as an efficient heat transfer medium, resulting in reduction in cooking time.

A steam cooking apparatus includes a steam generating device to generate and supply steam by heating water, a water supply device to supply water into the steam generating device, and a drainage device to drain water from the steam generating device. The steam generating device includes a steam container to generate steam, and a steam heater to heat water supplied into the steam container. The water supply device includes a water vessel and a water supply tube to transfer water stored in the water vessel into the steam container. The drainage device includes a drain tube and a drainage pump which are connected to the steam container and drain water remaining in the steam container to the outside of the steam cooking apparatus.

The water stored in the water vessel is supplied into the steam container through the water supply tube. The steam heater provided in the steam container is supplied with electric power and heats the water supplied into the steam container, thereby generating steam. The generated steam is supplied into a cooking compartment through a steam supply tube connecting the steam container and the cooking compartment to each other. After a cooking process is completed, water remaining in the steam container is discharged to the outside of the steam cooking apparatus via the drainage pump and the drain tube.

SUMMARY

It is an aspect of this disclosure to provide a steam cooking apparatus equipped with an improved water supply structure to supply water into a steam generator and an improved drain structure to drain water from the steam generator.

Additional aspects will be set forth in part in the description which follows and, in part, will be obvious from the description, or may be learned by practice of the invention.

In accordance with one aspect, a steam cooking apparatus includes a body having a cooking compartment, a steam generator to generate steam and supply the steam into the cooking compartment, a water vessel mounted above the steam generator to store water and supply the water into the steam generator, a water supply device including a holder mounted to a front portion of the body and a slider slidably mounted in the holder to be withdrawn from the body, a first water supply tube connecting the slider and the water vessel to guide water supplied through the slider into the water vessel, a second water supply tube connecting the water vessel and the steam generator to guide water in the water vessel into the steam generator, and a drain tube to drain water in the steam generator to the outside of the body. The drain tube includes an end fixed to the slider so that the end of the drain tube is withdrawn with the slider from the body when water in the steam generator is drained to the outside of the body.

The slider may include a water receiving part to receive water to be supplied to the water vessel, a connecting part protruding from a rear side of the water receiving part and connected with the first water supply tube, and a fixing part provided at a lower portion of the water receiving part to fix the end of the drain tube to the slider.

The water supply device may include a sensing unit to sense movement of the slider, and the sensing unit may include a lever configured to pivot by contact with the slider and a switch configured to be pressed by the pivoting motion of the lever.

The water supply device may further include a support part extending from the holder to support the lever and the switch, and the support part may include a coupling shaft to which the lever is pivotably coupled and an installation surface on which the switch is seated.

The water vessel may include an inlet hole through which water is supplied via the first water supply tube, and the connecting part may be located at a position higher than the inlet hole.

The water vessel may further include a communicating tube provided at an upper side thereof so that the inside of the water vessel communicates with the outside of the water vessel through the communicating tube, and the communicating tube may extend in an inward direction of the water vessel to prevent water in the water vessel from flowing to the outside of the water vessel through the communicating tube.

The water vessel may further include a slanted surface formed at a lower side thereof so that water in the water vessel smoothly flows into the second water supply tube.

The steam generator may include a steam container to store water supplied through the second water supply tube, a heater to heat water stored in the steam container, a steam supply tube to supply steam generated by the heater into the cooking compartment, and a short-circuit prevention bracket mounted below the steam container to prevent short-circuit of the heater.

The heater may include both ends disposed at the outside of the steam container, and the short-circuit prevention bracket may be coupled to the both ends of the heater at the outside of the steam container.

The short-circuit prevention bracket may include a base formed with through-holes through which the both ends of the heater tightly pass, at least one first guide portion bent upwardly from a side of the base to guide water on the base to flow toward the other side of the base, and at least one second guide portion bent downwardly from the other side of the base to guide water flowing along the first guide portion to fall downwardly from the base.

The short-circuit prevention bracket may further include a third guide portion extending downwardly from the second guide portion, and the third guide portion may have a smaller width than the second guide portion.

The steam cooking apparatus may further include an auxiliary steam generator connected to the steam generator, the auxiliary steam generator including a water level sensor provided therein to detect the level of water stored in the auxiliary steam generator.

The level of water stored in the steam generator may be substantially the same as the level of water stored in the auxiliary steam generator.

In accordance with another aspect, a steam cooking apparatus includes a body having a cooking compartment, and a steam generator to generate steam and supply the steam into the cooking compartment. The steam generator includes a steam container to store water, a heater to heat water stored in the steam container, the heater having both ends disposed at the outside of the steam container, a steam supply tube to supply steam generated by the heater into the cooking compartment, and a short-circuit prevention bracket coupled to the both ends of the heater to prevent short-circuit of the heater.

The short-circuit prevention bracket may include a base, through-holes formed at the base through which the both ends of the heater tightly pass, and at least one first guide portion bent upwardly from a side of the base to guide water on the base to flow toward the other side of the base.

The short-circuit prevention bracket may further include at least one second guide portion bent downwardly from the other side of the base to guide water flowing along the first guide portion to fall downwardly from the base.

The short-circuit prevention bracket may further include a third guide portion extending downwardly from the second guide portion, and the third guide portion may have a smaller width than the second guide portion.

In accordance with another aspect, a steam cooking apparatus includes a body having a cooking compartment, a steam generator to generate steam and supply the steam into the cooking compartment, a water supply device to supply water into the steam generator, a water supply tube connecting the water supply device and the steam generator to guide water supplied from the water supply device into the steam generator, and a drain tube to drain water in the steam generator to the outside of the body. The water supply device includes a holder mounted to a front portion of the body, and a slider slidably mounted in the holder, the slider including a water receiving part to receive water to be supplied to the steam generator, a connecting part protruding from a rear side of the water receiving part and connected with the water supply tube, and a fixing part provided at a lower portion of the water receiving part to fix an end of the drain tube to the slider.

The slider may be configured to move between a first position at which the slider is inserted into the body so that the water receiving part is hidden from view and a second position at which the slider is withdrawn from the body so that the water receiving part is visible.

When the slider moves to the second position, the end of the drain tube may be withdrawn with the slider from the body.

The water supply device may further include a sensing unit to sense movement of the slider, and the sensing unit may include a lever pivotably coupled to the holder, and a switch configured to intermittently contact the lever according to the pivoting motion of the lever.

When the slider is located at the first position, the slider may press the lever so that the lever contacts the switch, and when the slider is located at the second position, the slider may release the lever so that the lever moves away from the switch.

In accordance with a further aspect, a water level sensor control method of a steam cooking apparatus, including a body having a cooking compartment, a steam generator having a heater to generate steam to be supplied into the cooking compartment and a water level sensor to detect the level of water stored in the steam generator, includes turning the heater and the water level sensor ON (operation state)/OFF (non-operation state), and detecting the level of water stored in the steam generator by turning the water level sensor ON while the heater is kept in an OFF state.

The detecting the level of water may include turning the water level sensor ON after a certain time has elapsed since the heater was turned OFF.

The detecting the level of water may further include detecting the level of water stored in an auxiliary steam generator connected to the steam generator, the auxiliary steam generator being provided with the water level sensor therein and configured to have substantially the same water level as the steam generator.

As apparent from the above description, the steam cooking apparatus according to the aspects of this disclosure is highly durable because it is capable of preventing trouble which may be encountered in the process of supplying water into the steam generator or draining water from the steam generator.

Also, the steam cooking apparatus provides convenience in use because a user is able to easily perform both water supply for steam generation and drainage.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
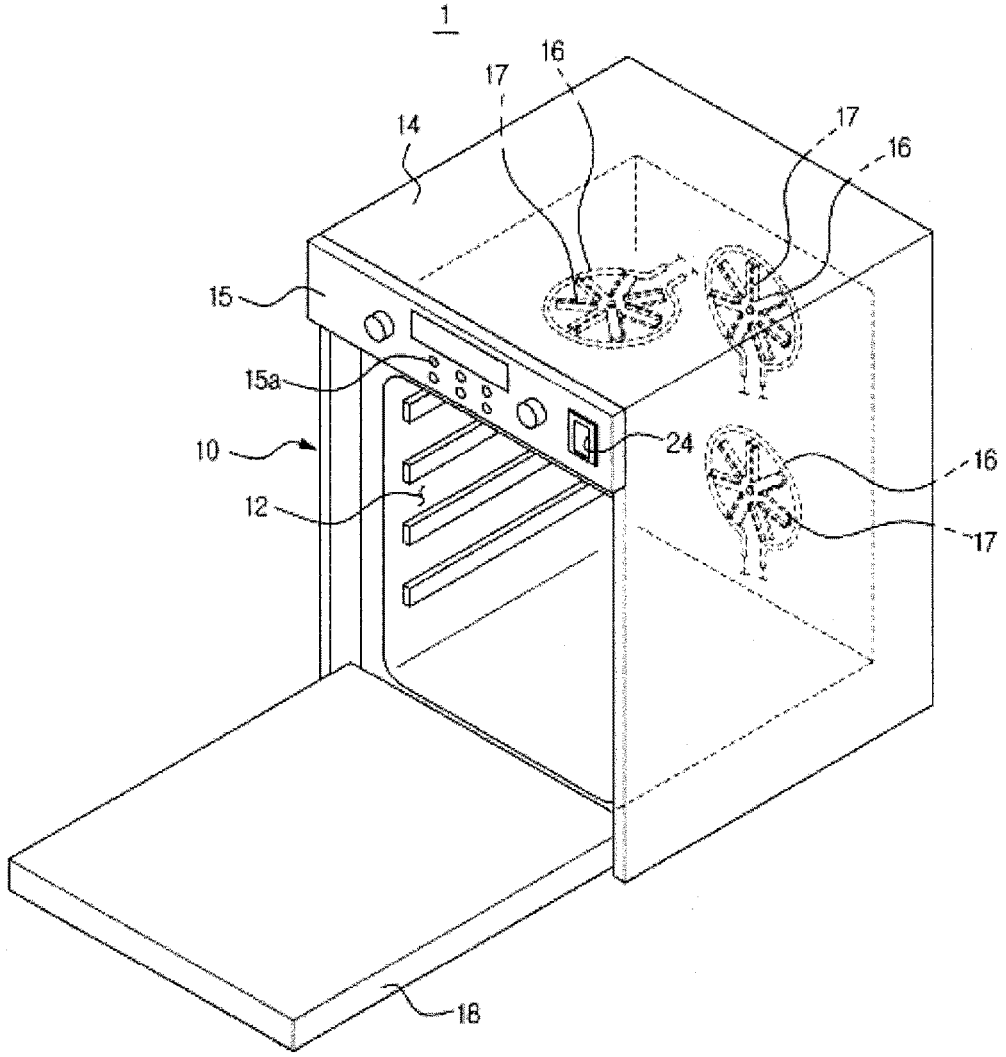
FIG. 1 is a perspective view showing a steam cooking apparatus according to an embodiment of the present invention.

Reference will now be made in detail to the embodiments of this disclosure, examples of which are illustrated in the accompanying drawings, wherein like reference numerals refer to like elements throughout.

Figure 2:
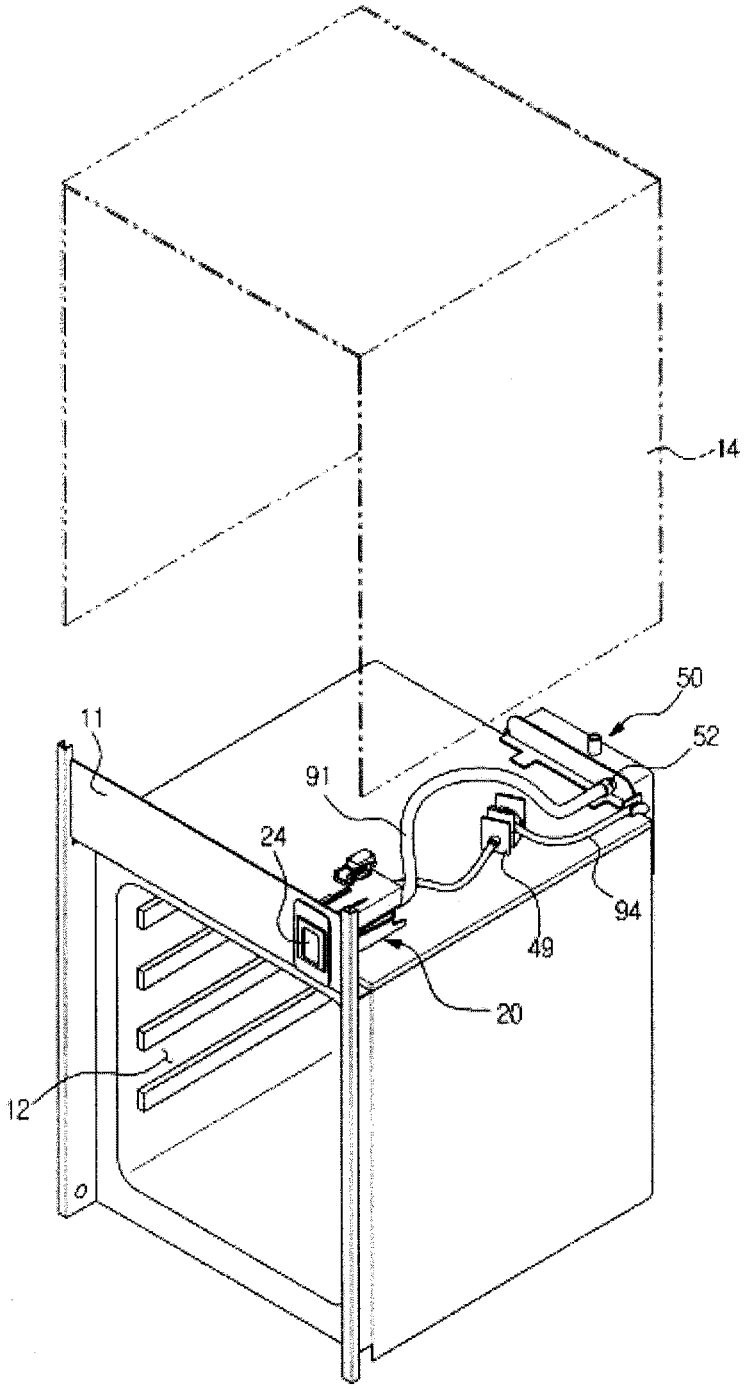
FIG. 2 is a perspective view showing the steam cooking apparatus depicted in FIG. 1, with a cover separated therefrom.
Figure 3:
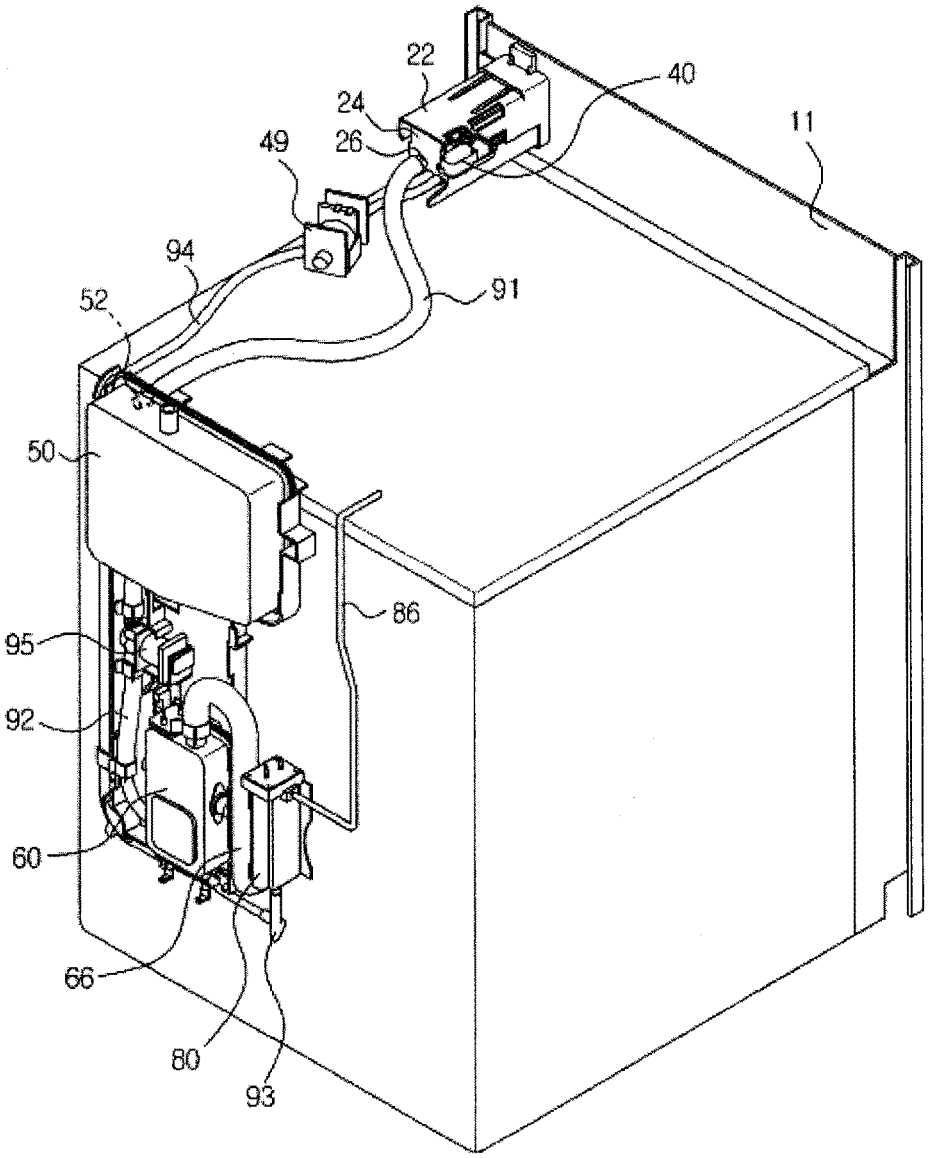
FIG. 3 is a perspective view showing the steam cooking apparatus depicted in FIG. 2, when viewed from the rear side.

FIG. 1 is a perspective view showing a steam cooking apparatus according to an embodiment of the present invention, FIG. 2 is a perspective view showing the steam cooking apparatus depicted in FIG. 1, with a cover separated therefrom, and FIG. 3 is a perspective view showing the steam cooking apparatus depicted in FIG. 2, when viewed from the rear side.

As shown in FIG. 1 through FIG. 3, a steam cooking apparatus 1 according to an embodiment of the present invention includes a body 10 forming an external appearance of the steam cooking apparatus 1 and internally having a cooking compartment 12, a cover 14 configured to cover an upper side, both lateral sides, and a rear side of the body 10, convection heaters 16 and convection fans 17 provided at upper and rear portions of the body 10 to heat the cooking compartment 12, and a steam generator 60 to generate steam and supply the generated steam into the cooking compartment 12.

The body 10 has an open front side for introduction and removal of food. On the front side of the body 10 is provided a door 18 to open and close the cooking compartment 12 in which food is disposed. A control panel 15 having operation switches 15*a* is provided at an upper portion of the front side of the body 10 for manual operation by a user. A water supply device 20 to supply water into the steam generator 60 is also provided at a side of the control panel 15.

The water supply device 20 includes a slider 24 which may be forwardly withdrawn from the front side of the body 10. By withdrawing the slider 24 from the body 10, a user may supply water into the steam generator 60 or discharge water from the steam generator 60.

The convection heaters 16 provided at the upper and rear portions of the body 10 supply heat into the cooking compartment 12. The convection fans 17 are adapted for convection of heat from the convection heaters 16 in the cooking compartment 12 or circulation of steam from the steam generator 60, separately from the convection heaters 16, in the cooking compartment 12.

In a space between the upper side of the body 10 and the cover 14 are mounted a first water supply tube 91 connecting the water supply device 20 and a water vessel 50 (which will be described later), a drain tube 94, and a drainage pump 49 connected to the drain tube 94 to drain water remaining in the steam generator 60 to the outside of the body 10. One end of the first water supply tube 91 is coupled to a connecting part 32 of the slider 24 of the water supply device 20, and the other end of the first water supply tube 91 is coupled to an inlet hole 52 of the water vessel 50. The water supplied into the slider 24 flows into the water vessel 50 through the first water supply tube 91. The connecting part 32 of the slider 24 is located at a position higher than the inlet hole 52 of the water vessel 50. Accordingly, the water supplied into the slider 24 flows into the water vessel 50 through the first water supply tube 91 by gravity without need for an additional pump.

The first water supply tube 91 frequently moves together with the slider 24 when the slider 24 is forwardly withdrawn from the body 10 or inserted into the body 10. Therefore, the first water supply tube 91 may be made of a material which is easily bent and is not permanently deformed after repeated movement, such as synthetic resin or rubber.

In a space between the rear side of the body 10 and the cover 14 are mounted the water vessel 50, the steam generator 60 disposed below the water vessel 50, and an auxiliary steam generator 80 connected to the steam generator 60. The water vessel 50 temporarily stores the water supplied from the water supply device 20. The steam generator 60 generates steam by heating the water supplied from the water vessel 50, and supplies the steam into the cooking compartment 12. The auxiliary steam generator 80 is provided with a water level sensor 84 to detect a level of the water stored in the steam generator 60.

The water vessel 50 and the steam generator 60 are connected to each other by a second water supply tube 92. The steam generator 60 and the auxiliary steam generator 80 are connected to each other by a third water supply tube 93. When the steam needs to be supplied into the cooking compartment 12, the water stored in the water vessel 50 flows into the steam generator 60 through the second water supply tube 92, and subsequently, the water introduced into the steam generator 60 flows into the auxiliary steam generator 80 through the third water supply tube 93. A valve 95 is coupled to the second water supply tube 92 to control the flow of water from the water vessel 50 to the steam generator 60.

The drain tube 94 is connected to a lower side of the steam generator 60 to drain water remaining in the steam generator 60 to the outside of the body 10. An end of the drain tube 94 is fixed to the slider 24 to be withdrawn with the slider 24 from the body 10 in the process of draining water remaining in the steam generator 60 to the outside of the body 10.

Hereinafter, the steam generator 60, the water vessel 50 and the water supply device 20 to supply water into the steam generator 60 and drain water from the steam generator 60 will be described in detail.

Figure 4:
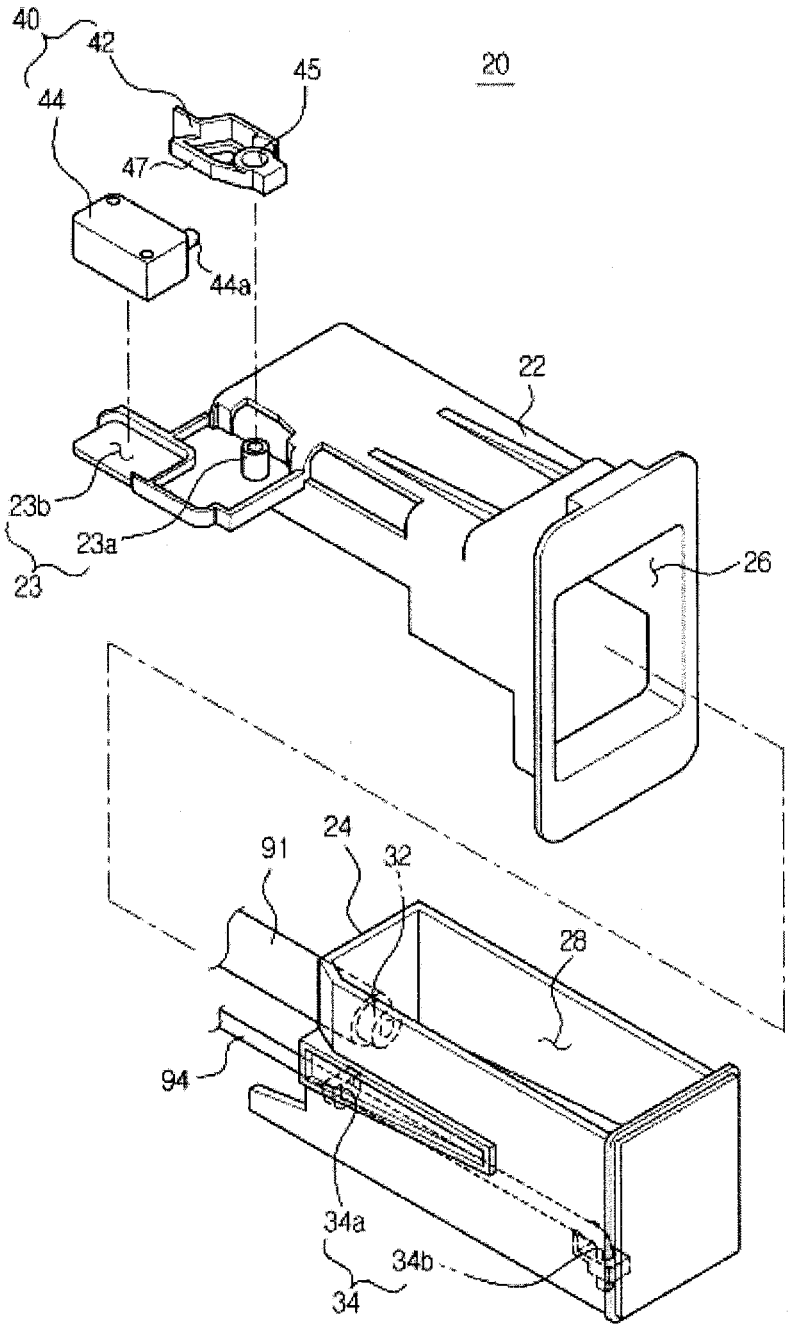
FIG. 4 is a perspective view showing a water supply device of the steam cooking apparatus according to the embodiment of the present invention.
Figure 5:
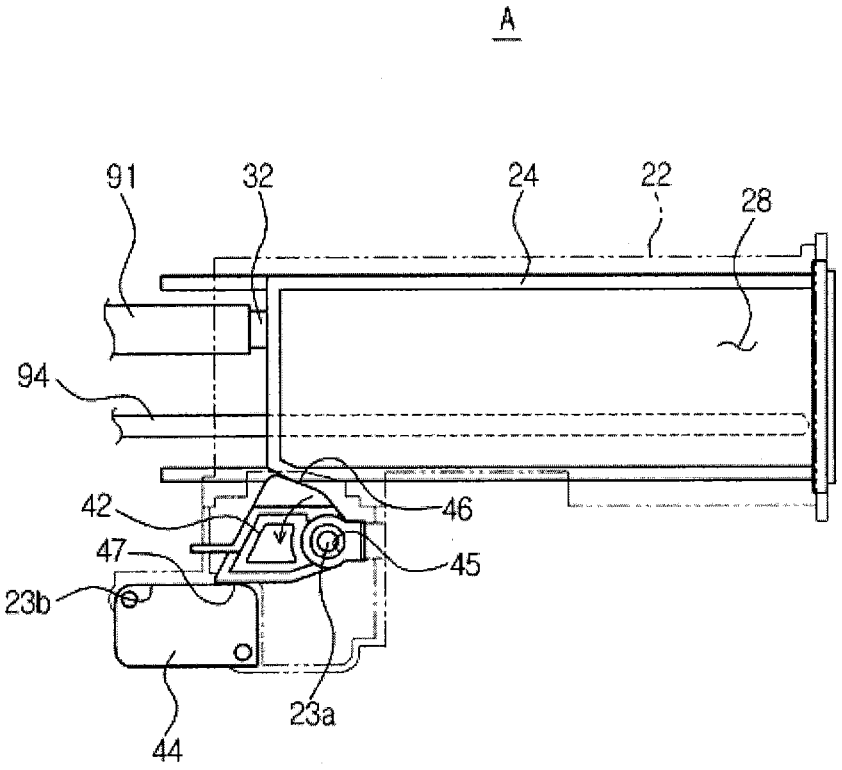
FIGS. 5 and 6 are plan views showing a slider of the water supply device located at a first position and a second position, respectively.
Figure 6:
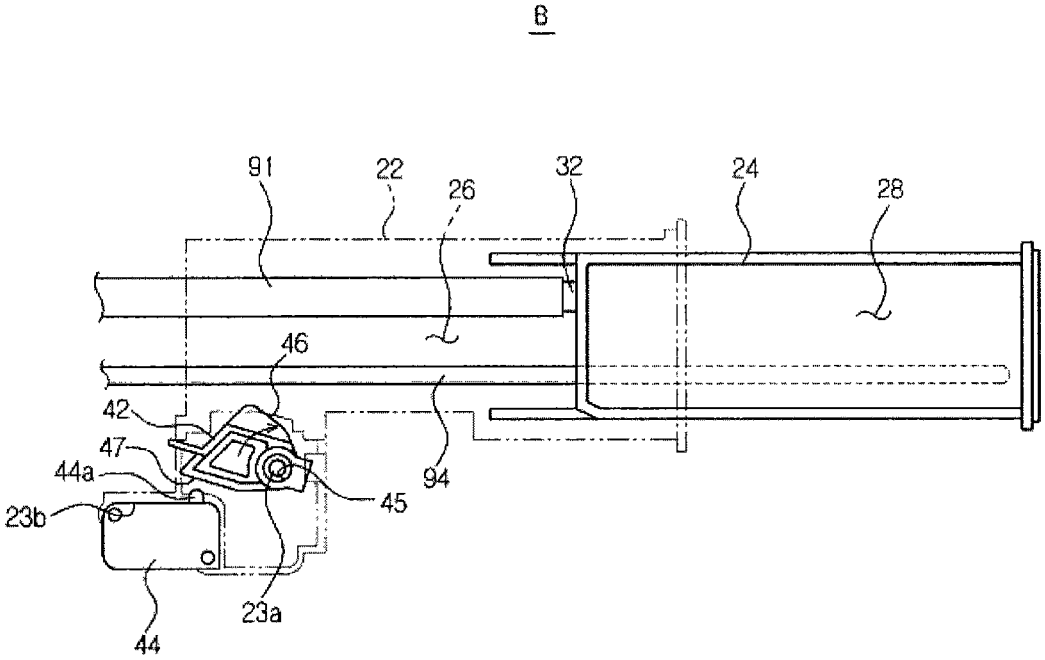

FIG. 4 is a perspective view showing the water supply device of the steam cooking apparatus according to the embodiment of the present invention, and FIGS. 5 and 6 are plan views showing the slider of the water supply device located at a first position and a second position, respectively.

As shown in FIG. 4 through FIG. 6, the water supply device 20 is provided at a front portion of the upper side of the body 10 so that a user may easily access the same. The water supply device 20 includes a holder 22 mounted to a front frame 11, the slider 24 slidably mounted in the holder 22, and a sensing unit 40 mounted to the holder 22 to sense movement of the slider 24.

The holder 22 is fixedly coupled to the front frame 11 positioned at the upper portion of the body 10, and is formed with a slider accommodating part 26 to accommodate the slider 24 thereinside. The slider accommodating part 26 may be provided with rails (not shown) therein, along which the slider 24 slides.

The slider 24 includes a water receiving part 28 to receive water supplied from the outside therein, a connecting part 32 protruding outwardly from a rear side of the water receiving part 28, and a fixing part 34 provided at a lower portion of the slider 24 to which the drain tube 94 is fixed. The connecting part 32 is connected with the first water supply tube 91 so that water in the water receiving part 28 flows into the water vessel 50 through the first water supply tube 91. The fixing part 34 includes a pair of fixing brackets 34*a* and 34*b* to support an end portion of the drain tube 94 to be securely and stably fixed to the slider 24. Accordingly, the end portion of the drain tube 94 is fixed to the lower portion of the slider 24 by the fixing part 34, and is withdrawn with the slider 24 from the body 10.

The sensing unit 40 for sensing movement of the slider 24 includes a lever 42 configured to pivot by contact with the slider 24, and a switch 44 configured to be turned ON/OFF by the pivoting motion of the lever 42.

The lever 42 and the switch 44 of the sensing unit 40 are supportedly coupled to a support part 23 extending from the holder 22 in an inward direction of the body 10. The lever 42 is pivotably coupled to a coupling shaft 23*a* extending upward from a bottom of the support part 23. The switch 44 is seated on an installation surface 23*b* formed as a part of the bottom of the support part 23. The switch 44 is located at such a position that the lever 42 presses a button 44*a* of the switch 44 by the pivoting motion thereof.

The lever 42 includes a coupling hole 45 through which the coupling shaft 23*a* of the support part 23 is inserted, a first contact portion 46 which is pressed by contact with the slider 24, and a second contact portion 47 which presses the button 44*a* of the switch 44 by contact with the button 44*a*.

As shown in FIG. 5 and FIG. 6, the slider 24 is configured to move between a first position A at which the slider 24 is totally inserted into the body 10 so that the water receiving part 28 and the drain tube 94 are hidden from view, and a second position B at which the slider 24 is forwardly withdrawn from the front side of the body 10 so that the water receiving part 28 and the drain tube 94 are visible.

When the slider 24 is located at the first position A at which the slider 24 is totally inserted into the body 10, the slider 24 presses the first contact portion 46 of the lever 42. Accordingly, the lever 42 pivots by a certain angle in the counterclockwise direction. As a result, the second contact portion 47 pushes the button 44*a* of the switch 44 to turn the switch 44 ON.

When the slider 24 is located at the second position B at which the slider 24 is forwardly withdrawn from the body 10, the slider 24 moves away from the first contact portion 46 of the lever 42 and no longer presses the first contact portion 46. Accordingly, the lever 42 pivots by a certain angle in the clockwise direction. As a result, the second contact portion 47 moves away from the button 44*a* of the switch 44 and no longer pushes the button 44*a* to turn the switch 44 OFF.

The switch 44 is electrically connected to a control unit (not shown) provided in the body 10. When the slider 24 is totally inserted into the body 10 and the switch 44 is kept in an ON state, the control unit controls the apparatus such that water in the steam generator 60 is not drained through the drain tube 94 fixed to the slider 24. On the other hand, when the slider 24 is forwardly withdrawn from the body 10 and the switch 44 is kept in an OFF state, the control unit controls the apparatus such that water in the steam generator 60 is drained through the drain tube 94 withdrawn together with the slider 24 according to a user command. Even though a user inputs a drain order by pushing a drain button provided at the control panel 15 by mistake when the slider 24 is totally inserted into the body 10, the drainage of water into the body 10 through the drain tube 94 is prevented.

Figure 7:
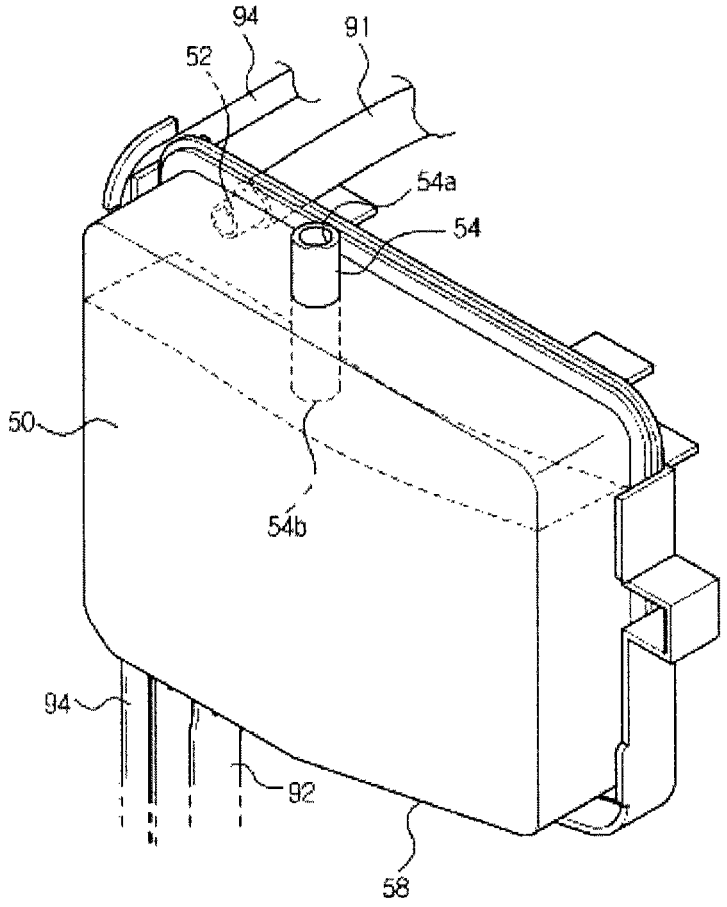
FIG. 7 is an enlarged perspective view showing a water vessel depicted in FIG. 3.

FIG. 7 is an enlarged perspective view showing the water vessel depicted in FIG. 3. As shown in FIG. 7, the water vessel 50 is formed in an approximately rectangular shape, and is designed to temporarily store water supplied from the water supply device 20. The water vessel 50 includes the inlet hole 52 connected with the first water supply tube 91, and a communicating tube 54 provided at an upper side of the water vessel 50 so that the inside of the water vessel 50 communicates with the outside of the water vessel 50 therethrough.

The inlet hole 52 communicates with the slider 24 of the water supply device 20 by the first water supply tube 91. The water received in the water receiving part 28 of the slider 24 flows into the water vessel 50 via the first water supply tube 91 and the inlet hole 52. The communicating tube 54 extends vertically through the upper side of the water vessel 50 in such a manner that a first end 54*a* of the communicating tube 54 is located at the outside of the water vessel 50 and a second end 54*b* of the communicating tube 54 is located at the inside of the water vessel 50. Air is introduced into the water vessel 50 through the communicating tube 54, and the air pressurizes water introduced into the water vessel 50 through the inlet hole 52 with the atmospheric pressure around the second end 54*b* of the communicating tube 54. Accordingly, the level of water in the water vessel 50 is kept constant, thereby preventing the water in the water vessel 50 from flowing to the outside of the water vessel 50 through the communicating tube 54.

The second water supply tube 92 is connected to a lower side of the water vessel 50 to supply water from the water vessel 50 to the steam generator 60. The lower side of the water vessel 50 has a slanted surface 58 so that water in the water vessel 50 may smoothly flow into the second water supply tube 92. The slanted surface 58 formed at the lower side of the water vessel 50 prevents water from remaining in the water vessel 50 while not flowing into the steam generator 60.

Figure 8:
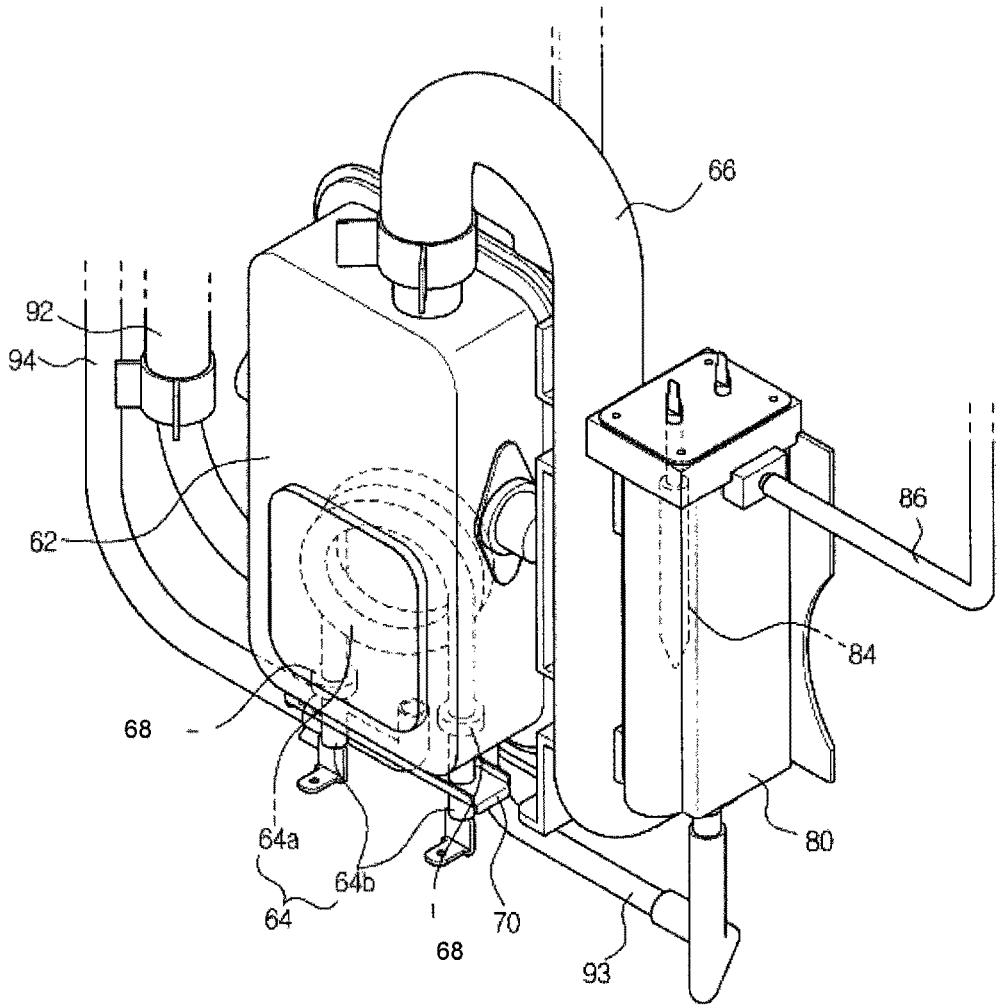
FIG. 8 is an enlarged perspective view showing a steam generator and an auxiliary steam generator depicted in FIG. 3.
Figure 9:
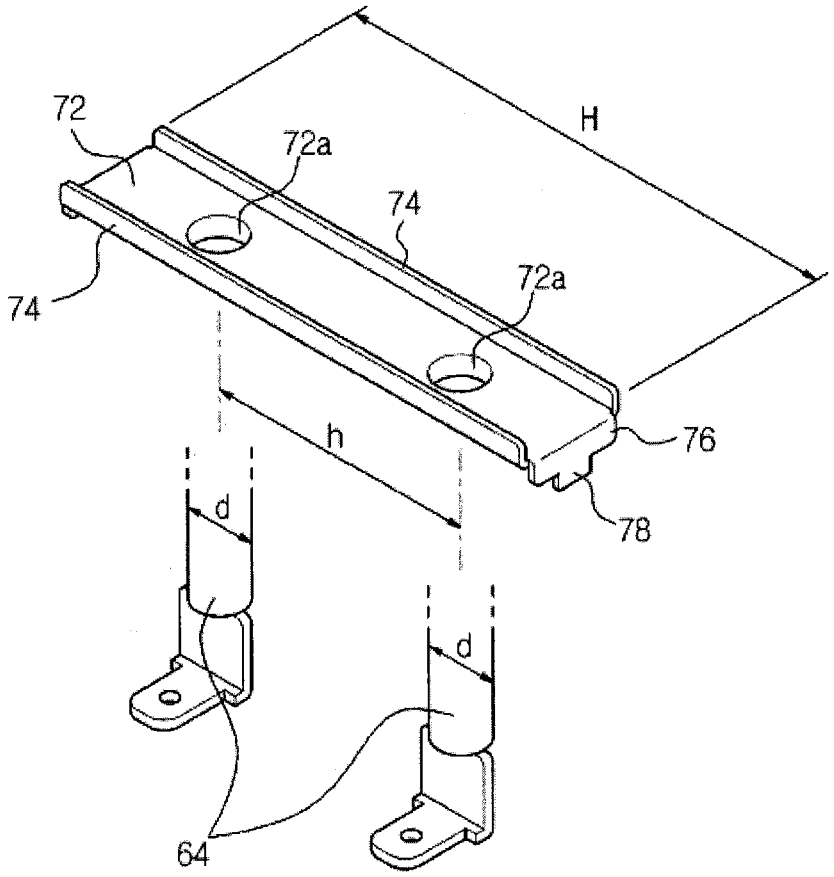
FIG. 9 is a perspective view showing a short-circuit prevention bracket mounted below the steam generator.

FIG. 8 is an enlarged perspective view showing the steam generator and the auxiliary steam generator depicted in FIG. 3, and FIG. 9 is a perspective view showing a short-circuit prevention bracket mounted below the steam generator.

As shown in FIG. 8 and FIG. 9, the steam generator 60 and the auxiliary steam generator 80 are disposed below the water vessel 50. The steam generator 60 and the auxiliary steam generator 80 are configured to generate steam and supply the same into the cooking compartment 12.

The steam generator 60 includes a steam container 62 to store water supplied through the second water supply tube 92, a heater 64 to heat water stored in the steam container 62, and a steam supply tube 66 to supply steam generated by heating water by the heater 64 into the cooking compartment 12.

The steam container 62 communicates with the water vessel 50 through the second water supply tube 92. The heater 64 includes a heating part 64*a* disposed in the steam container 62 and formed in a coil shape, and electrode parts 64*b* formed by extending the heating part 64*a* to the outside of the steam container 62. The electrode parts 64*b* are electrically connected to an external power source (not shown) to apply current to the heating part 64*a*, thereby raising the temperature of the heating part 64*a*. In order to prevent water in the steam container 62 from leaking to the outside, packing members 68 are provided at portions of the heating part 64*a* extending to the outside of the steam container 62.

A short-circuit prevention bracket 70 is coupled to the electrode parts 64*b* to prevent short-circuit of the heater 64. The short-circuit prevention bracket 70 includes a base 72 formed with through-holes 72*a* through which the electrode parts 64*b* of the heater 64 tightly pass, first guide portions 74 bent upwardly from two opposing sides of the base 72, and second guide portions 76 bent downwardly from the other two opposing sides of the base 72.

The base 72 of the short-circuit prevention bracket 70 has a width H which is larger than the sum of a distance h between the electrode parts 64*b* and a diameter d of one of the electrode parts 64*b*. The electrode parts 64*b* of the heater 64 are coupled to the base 72 of the short-circuit prevention bracket 70 by passing through the through-holes 72*a* of the base 72. The first guide portions 74 guide water on the base 72 to flow toward the second guide portions 76. The second guide portions 76 guide water flowing along the first guide portions 74 to fall downwardly from the base 72.

The short-circuit prevention bracket 70 may further include third guide portions 78 extending downwardly from the second guide portions 76. The third guide portions 78 have a smaller width than the second guide portions 76 so that water flowing to the second guide portions 76 may fall more narrowly therealong.

If the packing members 68 are damaged and thus water in the steam container 62 leaks and flows along the lower side of the steam container 62, a short-circuit, which allows current to travel between the electrode parts 64*b* and the steam container 62, may happen. As mentioned above, since the width H of the base 72 of the short-circuit prevention bracket 70 is larger than the sum of the distance h between the electrode parts 64*b* and the diameter d of one of the electrode parts 64*b*, the water leaking to the outside of the steam container 62 falls onto the base 72 and then falls downwardly along the first guide portions 74, the second guide portions 76 and the third guide portions 78 without contacting the electrode parts 64*b*, thereby preventing short-circuit.

The auxiliary steam generator 80 is disposed next to the steam generator 60. The auxiliary steam generator 80 is connected to the steam generator 60 by the third water supply tube 93. The water level sensor 84 is provided in the auxiliary steam generator 80 to detect the level of water in the steam generator 60. The reason for additionally mounting the auxiliary steam generator 80 is to correctly detect the level of water in the steam generator 60. In more detail, if the water level sensor 84 is provided in the steam generator 60, the value detected by the water level sensor 84 may be larger than the actual water level due to the pressure of steam generated in the steam generator 60.

Immediately after being supplied into the steam container 62, the water is supplied into the auxiliary steam generator 80 through the third water supply tube 93. The auxiliary steam generator 80 is provided with a communicating tube 86 through which the inside of the auxiliary steam generator 80 communicates with the outside. Due to such a construction, the level of water in the steam generator 60 (a height from a supporting surface, on which the steam cooling apparatus 1 is mounted, to a surface of water in the steam generator 60) is substantially the same as the level of water in the auxiliary steam generator 80 (a height from a supporting surface, on which the steam cooling apparatus 1 is mounted, to a surface of water in the auxiliary steam generator 80). Accordingly, the level of water in the steam generator 60 may be determined by detecting the level of water in the auxiliary steam generator 80.

The water level sensor 84 is always in contact with water in the auxiliary steam generator 80, and water around a tip portion of the water level sensor 84 may corrode the tip portion of the water level sensor 84 by being electrolyzed by current generated during the operation of the water level sensor 84. In order to prevent the corrosion of the tip portion of the water level sensor 84, the time during which current travels through the water level sensor 84 needs to be reduced. Hereinafter, a control method of the water level sensor 84, capable of reducing the time during which current travels through the water level sensor 84, will be described.

Figure 10:
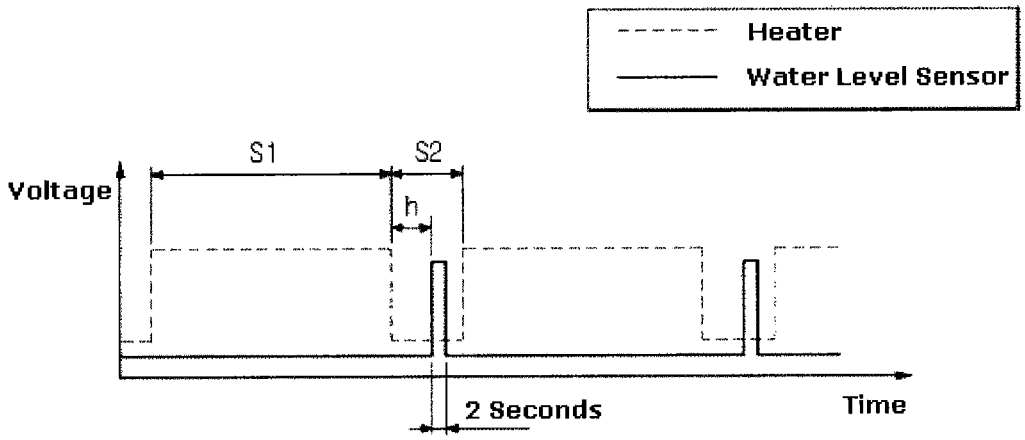
FIG. 10 is a view showing a control method of a water level sensor mounted in the auxiliary steam generator.

FIG. 10 is a view showing a control method of the water level sensor mounted in the auxiliary steam generator.

As shown in FIG. 10, the water level sensor 84 and the heater 64 are turned ON/OFF. While the heater 64 is kept in an OFF state (non-operation state), the water level sensor 84 may be controlled to be kept in an ON state (operation state). In detail, the water level sensor 84 is turned ON after a certain time t has elapsed since the heater 64 was turned OFF.

Under a condition that the heater 64 has a cycle in which the heater 64 is kept in an ON state for a certain time period of S1 seconds and kept in an OFF state for a certain time period of S2 seconds, the water level sensor control method will be described. Within the time period S2 during which the heater 64 is kept in an OFF state, current is allowed to travel through the water level sensor 84 for a relatively short time (about 2 seconds) after a certain time t has elapsed since the heater 64 was turned OFF, thereby measuring the level of water in the steam generator 60. The reason for turning the water level sensor 84 ON after a certain time t has elapsed since the heater 64 was turned OFF is to remove an influence of steam remaining in the steam generator 60 in the water level detection process, which is because steam remains in the steam generator 60 for the certain time t even after the heater 64 was turned OFF.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A steam cooking apparatus comprising:

a body having a cooking compartment;

a steam generator to generate steam and supply the steam into the cooking compartment;

a water vessel mounted above the steam generator to store water and supply the water into the steam generator;

a water supply device including a holder mounted to a front portion of the body and a slider slidably mounted in the holder so as to allow the slider to be at least partially slid out from the body to protrude outside the body and to be slid back into inside the body from protruding outside the body;

a first water supply tube connecting the slider and the water vessel to transfer water from the slider to the water vessel;

a second water supply tube connecting the water vessel and the steam generator to transfer water from the water vessel to the steam generator;

a drain tube to transfer water from the steam generator to the slider, the drain tube having a first end connected to the steam generator and a second end connected to a lower portion of the slider below the first water supply tube, extending into the slider, and configured to move relative to the body with the slider; and a first bracket to fix a part of the drain tube to a rear portion of an inside of the slider and a second bracket to fix the second end of the drain tube to a front portion of the inside of the slider, wherein the first water supply tube and the drain tube maintain the connection with the slider when the slider is at least partially slid out from the body to protrude outside the body.

2. The steam cooking apparatus according to claim 1, wherein the water supply device includes a sensing unit to sense the sliding of the slider, and wherein the sensing unit includes a lever configured to pivot by contact with the slider, and a switch configured to be pressed by the pivoting motion of the lever.

3. The steam cooking apparatus according to claim 2, wherein the water supply device further includes a support part extending from the holder to support the lever and the switch, and wherein the support part includes a coupling shaft to which the lever is pivotably coupled, and an installation surface on which the switch is seated.

4. The steam cooking apparatus according to claim 1, wherein the water vessel includes an inlet hole through which water is supplied via the first water supply tube.

5. The steam cooking apparatus according to claim 4, wherein the water vessel further includes a communicating tube provided at an upper side thereof so that the inside of the water vessel communicates with the outside of the water vessel through the communicating tube, and wherein the communicating tube extends in an inward direction of the water vessel to prevent water in the water vessel from flowing to the outside of the water vessel through the communicating tube.

6. The steam cooking apparatus according to claim 4, wherein the water vessel further includes a slanted surface formed at a lower side thereof so that water in the water vessel smoothly flows into the second water supply tube.

7. The steam cooking apparatus according to claim 1, wherein the steam generator comprises:

a steam container to store water supplied through the second water supply tube, a heater to heat water stored in the steam container, a steam supply tube to supply steam generated by the heater into the cooking compartment, and a short-circuit prevention bracket mounted below the steam container to prevent short-circuit of the heater.

8. The steam cooking apparatus according to claim 7, wherein the heater includes both ends disposed at the outside of the steam container, and wherein the short-circuit prevention bracket is coupled to the both ends of the heater at the outside of the steam container.

9. The steam cooking apparatus according to claim 8, wherein the short-circuit prevention bracket further comprises:

a base formed with through-holes through which the both ends of the heater tightly pass, at least one first guide portion bent upwardly from a side of the base to guide water on the base to flow toward the other side of the base, and at least one second guide portion bent downwardly from the other side of the base to guide water flowing along the first guide portion to fall downwardly from the base.

10. The steam cooking apparatus according to claim 9, wherein the short-circuit prevention bracket further comprises:

a third guide portion extending downwardly from the second guide portion, and wherein the third guide portion has a smaller width than the second guide portion.

11. The steam cooking apparatus according to claim 1, further comprising:

an auxiliary steam generator connected to the steam generator, the auxiliary steam generator including a water level sensor provided therein to detect the level of water stored in the auxiliary steam generator.

12. The steam cooking apparatus according to claim 4, wherein the level of water stored in the steam generator is substantially the same as the level of water stored in the auxiliary steam generator.

13. A steam cooking apparatus comprising:

a body having a cooking compartment; and a steam generator to generate steam and supply the steam into the cooking compartment, wherein:

the steam generator comprises:

a steam container to store water;

a heater to heat water stored in the steam container, the heater having both ends disposed at the outside of the steam container;

a steam supply tube to supply steam generated by the heater into the cooking compartment; and a short-circuit prevention bracket located directly below the steam container, spaced apart from the steam container and coupled to the both ends of the heater to guide leaked water from the steam container to flow along the short-circuit prevention bracket and away from the heater to prevent short-circuit of the heater in an event of water leaking from the steam container, the short-circuit prevention bracket comprising:

a base elongated in a widthwise direction of the steam container and having a substantially flat shape with a first side facing in a first direction toward the steam container and a second side facing in a second direction, opposite of the first direction, through-holes provided in the base through which the both ends of the heater tightly pass into the first side of the base and out of the second side of the base, and at least one first guide portion bent upwardly from at least one outer edge of the first side of the base in the first direction to guide the leaked water which leaks from the steam container and falls onto the first side of the base to flow in a direction substantially parallel to the widthwise direction and out of the short circuit prevention bracket in the event of the water leakage from the steam container.

14. The steam cooking apparatus according to claim 13, wherein the short-circuit prevention bracket further comprises at least one second guide portion bent downwardly from at least one other outer edge of the first side of the base to guide water flowing along the first side of the base to fall downwardly from the base, the at least one other edge of the first side of the base being perpendicular to the at least one outer edge of the first side of the base.

15. The steam cooking apparatus according to claim 14, wherein the short-circuit prevention bracket further includes a third guide portion extending downwardly from the second guide portion, and wherein the third guide portion has a smaller width than the second guide portion.

16. A steam cooking apparatus comprising:

a body having a cooking compartment;

a steam generator to generate steam and supply the generated steam into the cooking compartment;

a water supply device to supply water into the steam generator, and including a holder mounted inside a front portion of the body, and a slider slidably mounted in the holder so as to allow the slider to be at least partially slid out from the body to protrude outside the body and to be slid back into inside the body from protruding outside the body;

a water supply tube to transfer water from the water supply device to the steam generator, and having a first end connected to the steam generator and a second end connected to an upper portion of the slider and configured to move relative to the body with the slider;

a drain tube to transfer water from the steam generator to the water supply device, and having a first end connected to the steam generator and a second end connected to a lower portion of the slider below the water supply tube, extending into the slider, and configured to move relative to the body with the slider; and a first bracket to fix a part of the drain tube to a rear portion of an inside of the slider and a second bracket to fix the second end of the drain tube to a front portion of the inside of the slider, wherein the first water supply tube and the drain tube maintain the connection with the slider when the slider is at least partially slid out from the body to protrude outside the body.

17. The steam cooking apparatus according to claim 16, wherein the water supply device further includes a sensing unit to sense the sliding of the slider, and wherein the sensing unit includes a lever pivotably coupled to the holder, and a switch configured to intermittently contact the lever according to the pivoting motion of the lever.

18. The steam cooking apparatus according to claim 17, wherein when the slider is located at the first position, the slider presses the lever so that the lever contacts the switch, and when the slider is located at the second position, the slider releases the lever so that the lever moves away from the switch.

19. The steam cooking apparatus according to claim 13, further comprising:

a water supply device to supply water into the steam generator;

a water supply tube connecting the water supply device and the steam generator to guide water supplied from the water supply device into the steam generator; and a drain tube to drain water in the steam generator to the outside of the body.

20. The water supply device according to claim 19, further comprises:

a holder mounted to a front portion of the body; and a slider slidably mounted in the holder, wherein the slider comprises:

a water receiving part to receive water to be supplied into the steam generator, a connecting part protruding from a rear side of the water receiving part and connected with the water supply tube, and a fixing part provided at a lower portion of the water receiving part to fix an end of the drain tube to the slider.

21. The steam cooking apparatus according to claim 13, further comprising:

an auxiliary steam generator connected to the steam generator, the auxiliary steam generator including a water level sensor provided therein to detect the level of water stored in the auxiliary steam generator.

22. The steam cooking apparatus according to claim 21, wherein the water level of the steam generator is determined based off the water level of the auxiliary generator.

23. The steam cooking apparatus according to claim 22, wherein the level of water stored in the steam generator is substantially the same as the level of water stored in the auxiliary steam generator.

24. The steam cooking apparatus according to claim 1, wherein the first water supply tube is connected to the slider at a position vertically above a position at which the drain tube is connected to the slider.

25. The steam cooking apparatus according to claim 16, wherein a front surface of the slider is substantially flush with a front surface of the body when the slider is fully slid inside the body.

* * * * *